US007654052B2

(12) United States Patent
Cooper et al.

(10) Patent No.: US 7,654,052 B2
(45) **Date of Patent: *Feb. 2, 2010**

(54) BRIDGING MEMBER FOR CONCRETE FORM WALLS

(75) Inventors: Bruce Cooper, Northumberland (CA); G. Richie Scott, Dundalk (CA); Robert E. Sculthorpe, Northumberland (CA); Graham A. Knowles, Petersborough (CA)

(73) Assignee: ARXX Building Products, Inc., Toronto, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/856,593

(22) Filed: Sep. 17, 2007

(65) Prior Publication Data

US 2008/0016810 A1 Jan. 24, 2008

Related U.S. Application Data

(63) Continuation of application No. 11/295,465, filed on Dec. 7, 2005, now Pat. No. 7,284,351, which is a continuation of application No. 10/266,635, filed on Oct. 9, 2002, now Pat. No. 7,032,357, which is a continuation of application No. 09/937,440, filed as application No. PCT/IB99/00672 on Mar. 30, 1999, now abandoned.

(51) Int. Cl.
*E04C 1/00* (2006.01)

(52) U.S. Cl. ..... 52/309.11; 52/309.12; 52/426; 52/742.14

(58) Field of Classification Search ..... 52/426, 52/442, 309.11, 431, 379, 473, 309.12, 742.14
See application file for complete search history.

(56) References Cited

U.S. PATENT DOCUMENTS

| | | | | | |
|---|---|---|---|---|---|
| 1,924,724 | A * | 8/1933 | Olney | ..... | 52/379 |
| 3,530,634 | A * | 9/1970 | Adams | ..... | 52/687 |
| 5,065,561 | A * | 11/1991 | Mason | ..... | 52/309.12 |
| 5,570,552 | A * | 11/1996 | Nehring | ..... | 52/426 |
| 5,657,600 | A * | 8/1997 | Mensen | ..... | 52/426 |
| 7,032,357 | B2 * | 4/2006 | Cooper et al. | ..... | 52/426 |

* cited by examiner

*Primary Examiner*—Basil Katcheves
(74) *Attorney, Agent, or Firm*—Townsend and Townsend and Crew, LLP

(57) ABSTRACT

A building component having first and second high density foam panels and improved bridging members for connecting the panels that extend between and may be molded into the panels. The bridging members include a pair of elongated end plates oriented in a top to bottom direction of the panels, a pair of substantially identical web members joining the end plates and being substantially symmetrically disposed above and below a central horizontal axis of the bridging member, and a pair of strip members oriented in the top to bottom direction of the panels intersecting the web members. The web members have a unique configuration that maximizes load bearing capacity with a minimum amount of material. The strip members may abut against and be substantially flush with respective inner surfaces of the foam panels to assist in positioning and forming the panels during molding. Seating areas for positioning horizontally and/or vertically disposed rebar in predetermined positions are also provided.

19 Claims, 5 Drawing Sheets

BRIDGING MEMBER FOR CONCRETE FORM WALLS

CROSS REFERENCE TO RELATED APPLICATIONS

This application is a continuation of U.S. application Ser. No. 11/295,465 filed Dec. 7, 2005 now U.S. Pat. No. 7,284,351 which is a continuation of U.S. application Ser. No. 10/266,635 filed on Oct. 9, 2002, now U.S. Pat. No. 7,032,357, which is a continuation of U.S. application Ser. No. 09/937,440 filed Dec. 31, 2001 now abandoned which was the National Stage of International Application PCT/IB99/00672 filed Mar. 30, 1999, now abandoned, the disclosure of each is incorporated herein by reference in its entirety.

BACKGROUND OF THE INVENTION

1. Field of the Invention

This application relates to a building component of the type which is used to build up insulated concrete form ("ICF") walls in building construction, and more particularly to an improved bridging members used to connect the opposed insulated panels of an ICF.

2. Background of the Invention

In conventional construction in North America, concrete walls are normally produced by constructing form walls, pouring concrete into the space between the form walls and, upon the setting of the concrete, removing the form walls. Finishing materials are then added to the concrete walls as required.

Typically in residential construction, concrete basements and other concrete walls will be constructed in the manner discussed above and wood framing will be constructed as required on top of or beside the walls. Insulation will be inserted between the framing members and the wall finished inside and out as desired.

Clearly, both parts of this construction are inefficient. It is time-consuming and wasteful of materials to have to remove the form walls after the concrete walls are poured. Furthermore, it is now common to insulate all walls, including basement walls, particularly in colder climates, and framing and insulation must be installed separately inside the walls.

The piecemeal construction, which is inherent in the wood frame part of the structure is labor-intensive and expensive. As a result, there have been ongoing efforts for many years to provide more modular types of wall construction from which efficiencies can be gained. One such construction type is that with which the invention is concerned.

A system has been in use that combines a number of the operations normally associated with residential and other building construction to provide saving in materials, energy, etc. This system basically includes the use of a foam insulating material to construct permanent form walls. The form walls are constructed and the concrete poured and the form walls are then left in place. The concrete walls so formed need not be confined to basement walls, but may comprise all of a building's walls. No further insulation is necessary, and finishing materials may be applied to the interior and exterior of the wall as required.

A particularly advantageous type of ICF is disclosed in U.S. Pat. No. 5,567,600, the disclosure of which is incorporated by reference herein in its entirety. The '600 patent discloses a building component formed from two foam panels secured together by at least two bridging members. Each bridging member includes a pair of elongated end plates joined by a narrow strip member, a series of first narrow bracing members extending from adjacent a mid-point of the narrow strip member to positions spaced a short distance from the ends of the end plates, and a series of second narrow bracing members extending from positions on the first bracing members to positions on the strip member intermediate the plates and the mid-point of the strip member. While the component disclosed in this patent has numerous advantages, works well and has been commercially successful for a number of years, the bridging members used to connect the form walls do not make the most efficient use of the material from which they are constructed to resist lateral forces generated by the concrete or other building material poured in between the form walls. When more material is used to form the structural members than is actually required to withstand tensile and other loads, the resulting form walls are unnecessarily expensive and heavy. Existing ICF systems thus far proposed, while in many cases are very useful, suffer from these or other similar disadvantages.

Against this background, the invention provides a building component for use in such an ICF system, which when integrated into a wall construction, offers advantages over and avoids the drawbacks and disadvantages of the prior ICF systems.

SUMMARY OF THE INVENTION

It has been discovered that substantial advantages can be obtained where the building component used to build up an ICF wall includes bridging members that are engineered to combine an enhanced strengthening and reinforcing grid with a substantial reduction in material. Structural analysis of the bridging members has been performed to arrive at the invention using finite element analysis methods. The resulting structure of the bridging members achieved optimized strength from a minimized amount of material by the unique configuration of web members that form part of the bridging members. The web members of the invention are configured to use material on the most efficient manner such that the bridging members can resist larger loads or resist the same loads with less deflection than known structural members used to produce similar form walls.

The invention achieves these advantages by providing a building component that includes first and second high density panels, each having inner and outer surfaces, top and bottom, and first and second ends. The panes are typically arranged in spaced parallel relationship with their inner surfaces facing each other. At least two bridging members connect the panels, and preferably, although not necessarily, extend between and through and are molded into the panels. Each of the bridging members includes a pair of elongated end plates oriented in the top-to-bottom direction of the panels. A pair of substantially identical web members join the end plates together and are symmetrically disposed above and below a central horizontal axis of the bridging member. A pair of strip members, generally oriented in the top-to-bottom direction of the panels, are symmetrically disposed on opposite sides of a central vertical axis of the bridging members such that they are substantially flush with respective inner surfaces of the foam panels. The strip members intersect the pair of web members at positions above and below the central horizontal axis of the bridging member.

The strip members maybe ski-shaped with top and bottom ends curved toward a respective and plate. The strip members are wider than the web members in a direction parallel to the end plates or in the first-to-second end direction of the foam panels. The web members each includes a mid-portion having seating areas formed therein for positioning rebar relative to the bridging member and the foam panels.

The seating areas on the mid-portions of the web members can be formed on sides of the web members towards the top and bottom of the foam panels, as well on sides of the web members towards the first and second ends of the panels. The seating areas formed on the sides of the web members toward the top and bottom of the foam panels provide guide surfaces for horizontal rebar and the seating areas formed on the sides of the web members toward the first and second ends of the panels provide guide surfaces for vertical rebar. The seating areas are particularly useful for forms used to make 4" walls, which have reduced clearances compared to larger walls. A novel V-shaped seating area for horizontal rebar can be formed with a vertically oriented outer edge such that any size rebar seated in the seating area will be positioned with a constant distance between the outer edge of the rebar and the outer edge of the concrete or other poured building material. The advantage of positioning horizontal rebar with a controlled minimum amount of concrete or other pourable building material between the outer edge of the rebar and the outer surface of the concrete is especially important with the forms used to make 4" walls. The horizontal and vertical rebar seating features of the invention can be employed on bridging members of any design in which rebar is used.

Each of the web members that connect the end plates may have a substantially X-shape. Alternatively, the web members may each have a substantially X-shaped portion or a double Y-shaped portion in the area between the pair of strip members. In this embodiment, the ends of the X-shaped or double Y-shaped portions merge at the strip members with V-shaped portions. The V-shaped portions connect the end plates of the bridging member to the substantially X-shaped or double Y-shaped portions. The web members, V-shaped portions and end plates that form the bridging member may be constructed integrally from high density plastic, such as polypropylene or polyethylene, or may be formed separately and snap-fit together using conventional means known in the art. In particular, the V-shaped portions and end plates may be integrally formed and snap-fit to the web members.

The configurations of the web members of the invention have been determined by finite element-type structural analysis to have an improved ability to resist and uniformly distribute the lateral forces exerted by wet concrete or other pourable building materials poured in between the form panels. The V-shaped portions of the web members that make up the opposite end portion of the bridging member define truss-like members having increased open areas compared to existing design for the foam that makes up the form walls to pass through the web members, thereby increasing the aggregate strength of the foam panels as the web/foam panel interface.

A further advantage of the finite element designed web members of the invention is the increased ability of the end plates to resist downward loads exerted by finishing materials attached to the end plates of a building component after construction of a wall. The substantially symmetrical design of the web members also enhances the stacking ability of the bridging members for transportation and storing purposes. Another factor in determining the configuration of the web members, is the ability to stack the completed building components formed from the bridging members and the foam panels. The preferred configuration of the web members allow for a greater number of completed building components to be stacked in the same height, thereby increasing the number of components that can be carried per shipping container. Stacking pins can also be provided extending from the sides of the web members to assist in positioning bridging members relative to each other in stacks before they are joined with the foam panels.

The symmetrically disposed strip members oriented in the top to bottom direction of the panels and extending to a width greater than the web members in a direction parallel to the end plates provide further advantages during the manufacturing of the building component. The shape and positioning of the strip members enhances their ability to resist the pressure of expanding foam during the process of molding the foam panels about the opposite end portion of the bridging member. The strip members also serve a structural function in assisting to resist downward loads imposed by finishing materials attached to the wall.

It is to be understood that both the foregoing general description and the following detailed description are exemplary and explanatory and are intended to provide explanation and context for the invention, the scope of which is limited solely by the appended claims.

BRIEF DESCRIPTION OF THE DRAWINGS

The accompanying drawings, which are included to provide a further understanding of the invention and are incorporated in and constitute a part of the specification, illustrate preferred embodiments of the invention and together with the detailed description below serve to explain the principles of the invention. In the drawings.

DESCRIPTION OF THE PREFERRED EMBODIMENTS

Reference will now be made in detail to preferred embodiments of the invention, examples of which are illustrated in the accompanying drawings.

Figure 1:
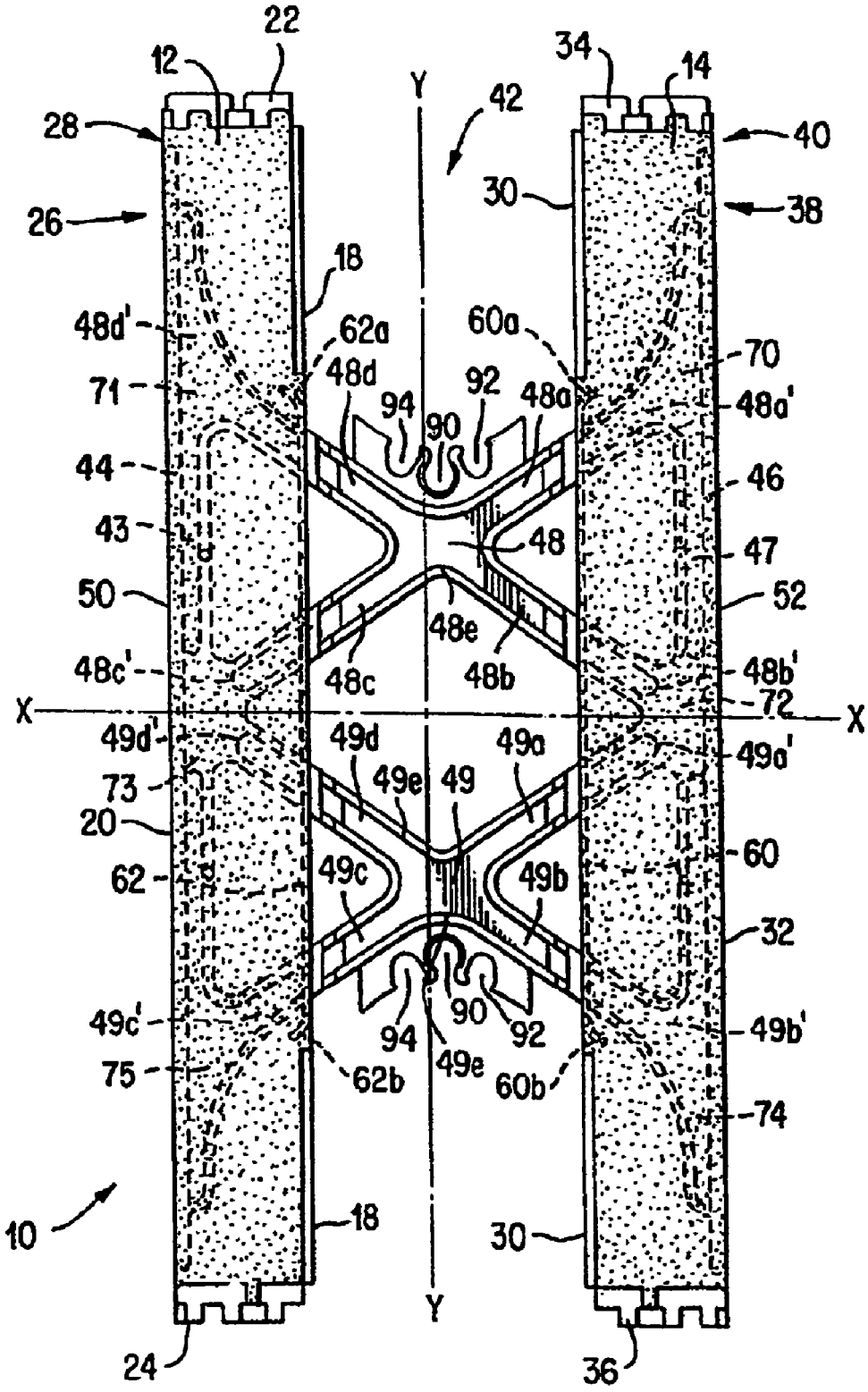
FIG. 1 is a side elevation view of a building component having a bridging member formed from substantially X-shaped web members constructed according to a first embodiment of the invention.
Figure 2:
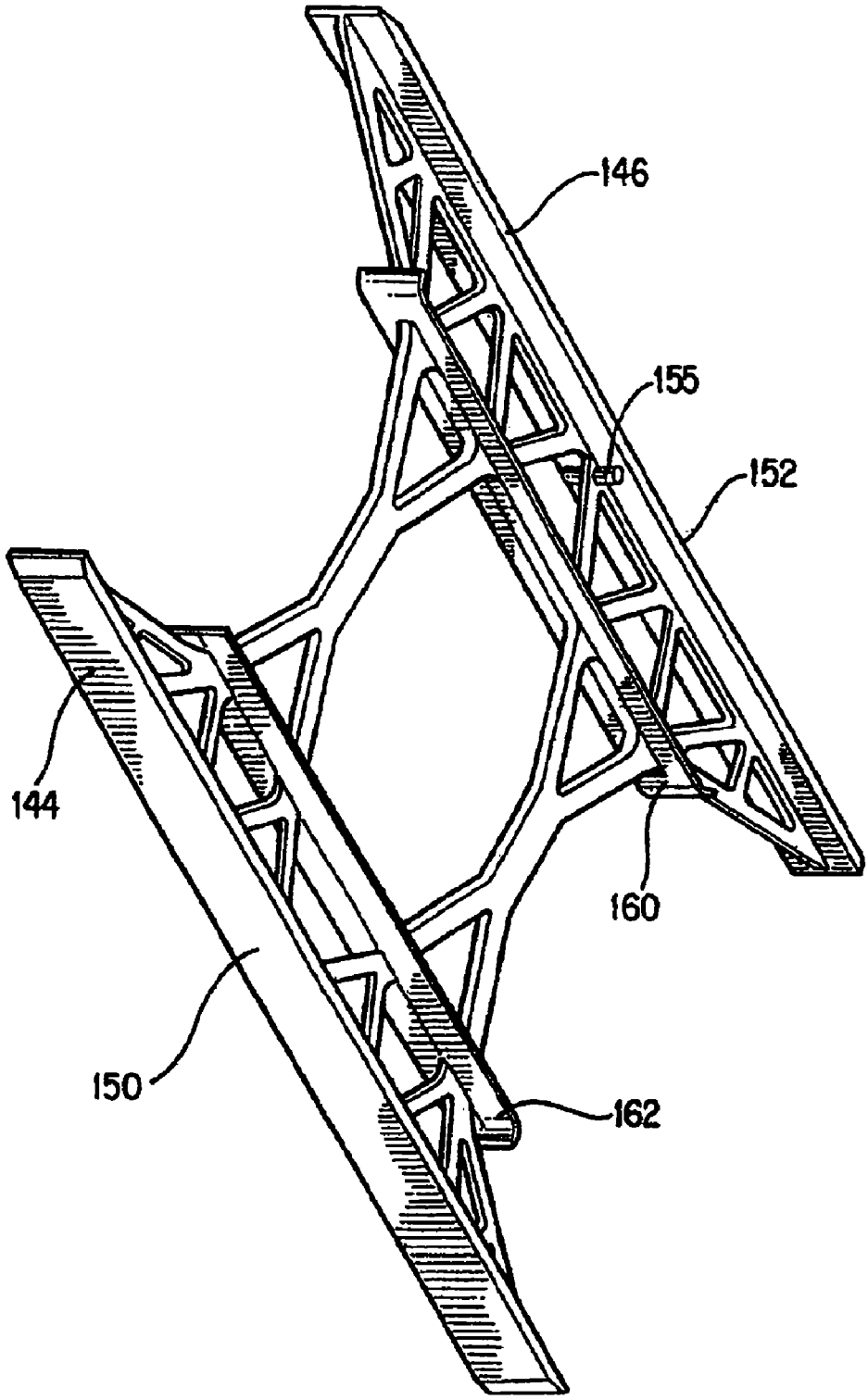
FIG. 2 is a perspective view of a bridging member having double Y-shaped web members constructed according to a second embodiment of the invention.
Figure 3:
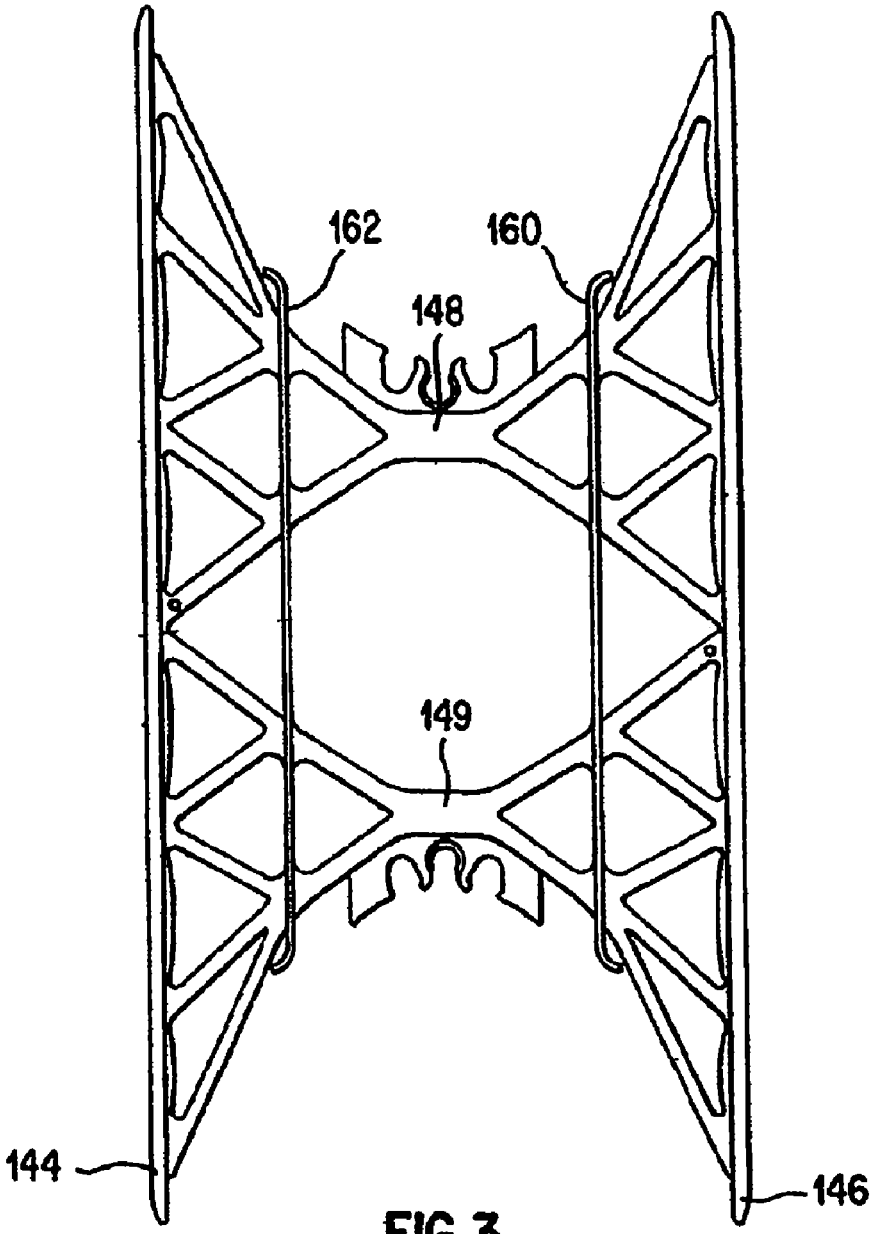
FIG. 3 is a side elevation view of a bridging member having double Y-shaped web members constructed according to a third embodiment of the invention.
Figure 4:
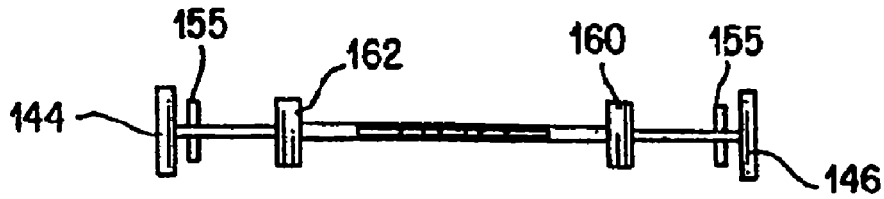
FIG. 4 is a top plan view of the bridging member of FIG. 3.

An ICF building component 10 shown in FIG. 1 comprises first and second insulating foam panels 12 and 14 secured together by at least two bridging members 42, which can generally be thought of as any structure used to connect the panels together consistent with the purposes and objectives of the invention.

Panel 12 has inner and outer surfaces 18 and 20 respectively, top and bottom 22 and 24 respectively, and first and second ends 26 and 28. Panel 14 has inner and outer surfaces 30 and 32, top and bottom 34 and 36, and first and second ends 38 and 40.

The panels 12 and 14 can be formed from fire retardant expanded polypropylene, polystyrene, polyethylene or other suitable polymers with expanded polystyrene commonly referred to as "EPS" being preferred. Subject to indentations and protrusions of minor dimensions, which can be any structure used to connect the forms together vertically to form a wall as discussed below, the panels are of generally uniform rectangular cross-section. In a typical case, each panel may be 48 inches long, 16¾ inches high and 2⅝ inches thick.

Each bridging member 42 may be formed from a single integral unit molded of plastic, with the preferred plastic being high-density flame retardant polypropylene, although flame retardant polyethylene, polystyrene and other suitable polymers may be used. Alternatively, the bridging member may be formed in separate pieces that in use are connected together by means known in the art, such as map-fits or other connections. This permits the width of the finished wall to be selected at the job site and reduces the volume of the form for shipping.

In the embodiment of FIG. 1, bridging member 42 includes a pair of elongated end plates 44 and 46 joined by a pair of substantially identical web members 48 and 49, which are generally symmetrically disposed above and below a central horizontal axis X-X of the bridging member 42.

As shown in FIG. 1, the end plates 44 and 46 are recessed into the panels such that their outer surfaces 50 and 52, respectively, not only abut, but are substantially flush with, i.e., lie in the same plane, as the outer surfaces 20 and 32 of panels 12 and 14, respectively. End plates 44 and 46 are oriented in the top-to-bottom or vertical direction relative to the panels 12 and 14 as they would be positioned in use in a vertical wall.

A pair of ski-shaped strip members 60 and 62, whose function is described subsequently, is also oriented in the top-to-bottom direction of the panels 12 and 14 and are symmetrically disposed on opposite sides of a central vertical axis Y-Y of the bridging member 42 (when each panel has the same width). The strip members lie in plates that are generally parallel to the inner surfaces 18, 30 of the panels and perpendicular to the plane of the web members 48, 49.

Bridging members 42 preferably are molded into the panels 12 and 14 in the course of producing the panels such that opposite end portions of the bridging members (including the end plates and portions of the web members) are encased within the foam making up the panels. In the completed building component 10, strip member 60 abuts against and is flush with the inner surface 30 of panel 14 and strip member 62 abuts against and is flush with the inner surface 18 of panel 12. Each plates 44 and 46 may be of substantially equal height as the panels 12 and 14 and may be substantially flush with the top and bottom ends of the panels, which does require them to extend completely to the ends. In fact, it is preferred for the end plates 44, 46 to short distance from the ends of panels as shown in FIG. 1, which facilitates connection and stacking of the forms to build a wall. As described in U.S. Pat. No. 5,567,600, the end panels of stacking forms align to form continuous furring strips for attaching finishing materials to the completed wall. Of course, one of ordinary skill in the art will recognize that alternative embodiments of the invention includes the end plates being completely buried within the foam panels 12 and 14, or being partially buried, in which case, portions of the end plates would be exposed, such as by the formation of openings though the foam panels, as is known in the art. The end plates could also extend above and/or below the top and bottom of the panels.

As shown in FIG. 1, each of the web members 48 and 49 has a substantially X-shaped configuration. The upper web member 48 has two diverging legs 48*a* and 48*b* extending from the central vertical axis Y-Y of the bridging member 42 toward the end plate 46. Diverging leg 48*a* merges with the end plate 46 at a distal end 48*a*' near the upper end 46*a* of the end plate 46. Diverging leg 48*b* merges with end plate 46 at its distal end 48*b*' near the center of the end plate 46.

On the opposite side of the vertical axis Y-Y diverging legs 48*d* and 48*c* merge with end plates 44 near the top end 44*a* of the end plate 44 and near a center portion of the end plate. Bridging member 42 is substantially symmetrical about horizontal axis X-X such that lower web member 49 similarly includes diverging legs 49*a* and 49*b* that merge with end plates and diverging legs 49*d* and 49*c* that merge with end plate 44.

Along end plate 46, the distal end 48*a*' of diverging leg 48*a* widens into an enlarged area 70 at the inside surface of end plate 46. Diverging leg 48*b* from web member 48 and diverging leg 49*a* from web member 49 merge at their respective distal ends 48*b*' and 49*a*' to form an enlarged area 72 at the inside surface of end plate 46. Diverging leg 49*b* of web member 49 widens at its distal end 49*b*' to form an enlarged area 74 at the inside surface of end plate 46. The areas 70, 72 and 74 may be interconnected by a reinforcing rib 47 extending along the inside surface of end plate 46. The outer periphery of web members 48 and 49 along with the inside edge of reinforcing rib 47 and the entire central enlarged area 72 can be provided with a greater thickness in a direction parallel to the first-to-second end direction of the panels that the remaining area of the web members and reinforcing rib to provide greater rigidity to the entire bridging member 42. The greater thickness area around the outer periphery of web member 48 forms a rim 48*e*, and the greater thickness area around the outer periphery of web member 49 forms a rim 49*e*.

Symmetrically disposed on the opposite side of the vertical axis Y-Y, diverging leg 48*d* merges with end plate 44 at a distal end 48*d*' that widens into an area 71 at the inside surface of end plate 44. Diverging leg 48*c* of web member 48 and diverging leg 49*d* of web member 49 merge at their distal ends 48*c*' and 49*d*' into an area 73 at the inside surface of end plate 44. Diverging leg 49*c* of web member 49 merges at a distal end 49*c*' into an area 75 at the inside surface of the lower end 44*b* of the plate 44.

Symmetrically disposed on opposite sides of the vertical axis Y-Y of bridging member 42, strip members 60 and 62 intersect the diverging legs of web members 48 and 49 and about and are substantially flush with inner surfaces 30 and 18 of panels 14 and 12, respectively. Each of the strip members 60 and 62 is substantially ski-shaped, with opposite ends 60*a* and 60*b* of strip member 60 curving outwardly toward end plate 46 and with opposite ends 62*a* and 62*b* of strip member 62 curving outwardly toward end plate 44. The width of strip members 60 and 62 in a direction along an axis Z (or in the first-to-second end direction of the foam panels and perpendicular to the page in FIG. 1) is greater than the width of the rest of the web members 48 and 49, includes greater that the width of the thicker rim portion 48*e* around the outer periphery of web member 48 and the thicker rim portion 49*e* around the outer periphery of web 49.

The function of the strip members 60 and 62 is two-fold. During molding of the foam panels, they assist in positioning the bridging member 42 in the molds before the foam material is injected into the olds to form foam panels 12 and 14, and also help to seal against the flow of foam beyond the desired inner surfaces 30 and 18 panels 14 and 12 respectively, Secondly, strip members 60, 62 function structurally to help resist forces imposed on the form when finishing materials are attached to the end plates 44, 46.

The web members having the above-described configuration can be sized to result in poured concrete walls having approximately 4 inches of concrete, 6.25 inches, 8 inches or other thickness of concrete between the foam panels. The dimensions of the web members between the strip members and the end plates can vary depending on whether the end plates are to be completely or partially buried within the foam panels, exposed or exposed and flush with the outer surfaces of the foam panels.

Figure 7:
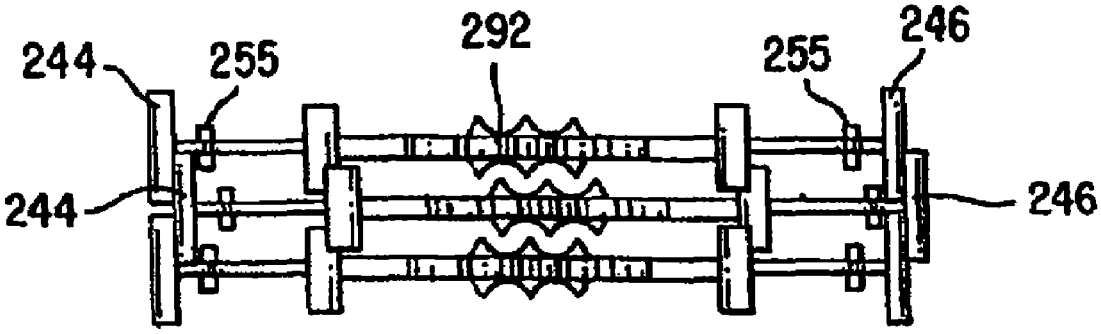
FIG. 7 is a side elevation view of a stack of bridging members constructed according to the principles of the invention having vertical rebar positioning features.

The top side of the member 48 and the bottom side of web member 49 can be profiled or otherwise formed to provide a series of seats for rebar positioning. Referring to FIG. 1, seats 90, 92 and 94 are generally curved to receive horizontal rebar rods. In addition to the seats on the sides of web members 49 and 49 toward the top and bottom of the panels, respectively, additional seating surfaces can be provided on the sides of the web members toward the first and second ends of the panels, such as seating surfaces 292 shown in FIG. 7. Seating surface provided on the sides of the web members towards the first and second ends of the panels provide seats for vertical rebar rods. Seating surfaces 292 shown in FIG. 7 are particularly important when the bridging members are approximately 4 inches wide to form 4 inch thick walls (i.e., a "4-inch form"). With a 4-inch form, the amount of concrete covering the vertical rebar between the vertical rebar and the foam panels as required by most building or other regulations necessitates positioning of the vertical rebar.

In further embodiments shown in FIGS. 2-6, an alternative configuration for the web members described above was derived using finite type structural analysis in order to maximize the strength of the bridging member while minimizing the amount of material used to form the member. The bridging member 142 shown in FIG. 5 includes a pair of elongated end plates 144 and 146 joined by web members 148 and 149, which may be generally symmetrically disposed above and below a central, horizontal axis X-X of the bridging member 142. Compared to the FIG. 1 embodiment, the web members 148, 149 have a slightly enlarged central portion, so the web members 148, 149 can be generally described as having a "double-Y" shape. As shown best in FIG. 5, top web member 148 has a mid portion 148*e* with two diverging legs 148*a* and 148*b* extending toward end plate 146 from one side of the mid portion 148*e* and two diverging legs 148*d* and 148*e* extending from the opposite side of mid portion 148*e* toward end plate 144. Similarly, web member 149 has two diverging legs 149*a* and 149*b* that extend from one end of mid portion 149*e* toward end plate 146, and two diverging legs 149*d* and 149*c* that extend from the opposite end of mid portion 149*c* toward end plate 144. The diverging legs of both web members 148 and 149 intersect with strip members 160 and 162 that extend in a top-to-bottom direction of the bridging member 142. Strip members 160 and 162 may be generally symmetrically disposed on the both sides of a vertical axis Y-Y of the bridging member 142 (again, when each panel has the same width).

The strip members 160 and 162 are generally ski-shaped and include opposite ends 160*a*, 160*b*, 162*a* and 162*b* that curve outwardly toward respective end plates 146 and 144. The strip members 160 and 162 are also wider than the remaining portions of the web members in a direction parallel to the end plates (perpendicular to the page in FIG. 5). Similarly to the embodiment shown in FIG. 1, strip members 160 and 162 not only abut but are substantially flush with the inside surfaces of foam panels (not shown) to be molded to opposite end portions of the web members. The ski-shaped strip members 160 and 162 may have the same functions as strip members 60, 62 described above.

Diverging leg 148*a* of web member 148 merges with 3 further diverging legs, 170, 172 and 174 at strip member 160. Legs 170, 172 and 174 define two V-shaped portions extending between strip member 160 and end plate 146. The substantially triangular-shaped openings defined by the V-shaped portion, strip member 160 and end plate 146 allow for passage of foam when bridging member 142 is molded into the spaced parallel foam walls. Diverging leg 148*b* of web member 148 merges with a V-shaped portion defined by legs 176 and 178 extending from strip member 160 to end plate 146.

Web member 148 is substantially symmetrical about a vertical axis Y-Y of bridging member 142 such that diverging legs 148*d* and 148*c* diverging from mid portion 148*e* intersect with strip member 162 and merge into legs 171, 173, 175, 177 and 179 to form V-shaped portions extending between the strip member 162 and end plate 144.

Bridging member 142 is also substantially symmetrical about a horizontal axis X-X with web member 149 preferably being configured identically to web member 148. Diverging legs 149*a* and 149*b* extend from mid portion 149*e* of web member 149 toward end plate 146. The diverging legs 149*a* and 149*b* intersect with strip member 160, at which point they merge into legs 180, 182, 184, 186 and 188 to form V-shaped portions extending between strip member 160 and end plate 146. Similarly, on the opposite side of vertical axis Y-Y of bridging member 142, legs 149*d* and 149*c* diverging from mid portion 149*e* of web member 149 to intersect strip member 162, and then merge into legs 181, 183, 185, 187 and 189 to form V-shaped portions extending between strip member 162 and end plate 144. The V-shaped portions extending between strip member 162 and end plate 144 also define substantially triangular-shaped openings through which foam can pass when bridging member 142 is molded into two parallel spaced foam panels. The V-shaped portions on each side of the bridging member, i.e., the portions defined by legs 170, 172, 174, 176, 178, 180, 182, 184, 186, 188 on one hand and those defined by legs 171, 173, 175, 177, 179, 181, 183, 185, 187, 189 on the other hand, may be though of as truss members extending between end plate 146 and strip member 160, or end plate 144 and strip member 162. The truss members may be formed with the end plates and strip members as an integral unit, which is then molded into the panels. The web members may be separated forming and snap fit or connected to projections extending from the strip members, in any conventional manner known in the art.

The opposite ends 162*a* and 162*b* of strip member 162 curve outwardly toward end plate 144, and the opposite 160*a* and 160*b* of strip member 160 curve outwardly toward end plate 146. Strip members 160 and 162 extend beyond web members 148 and 149 in both the top-to-bottom direction of bridging member 142 and in the perpendicular direction along axis Z (perpendicular to the page in FIG. 5).

Figure 5:
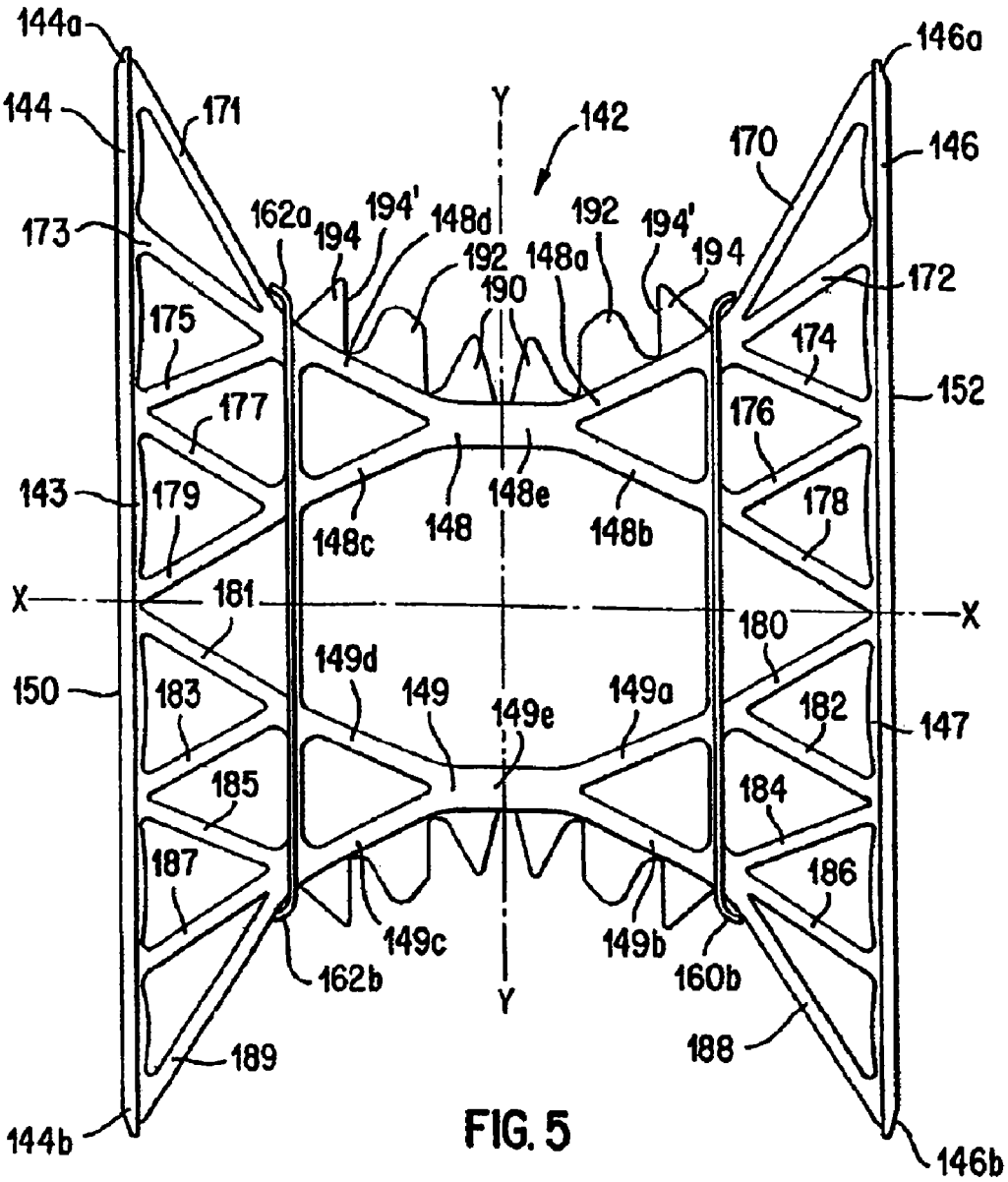
FIG. 5 is a side elevation view of a bridging member according to a fourth embodiment of the invention, which is similar to the third embodiment, except for the rebar positioning features.
Figure 6:
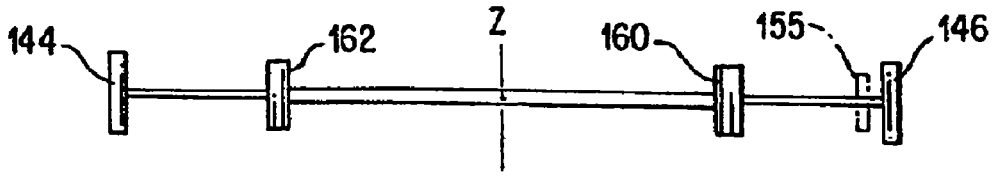
FIG. 6 is a top plan view of the bridging member of FIG. 5.

Triangular projections 190, 192 and 194 shown in FIG. 5 along a top edge of web member 148 and along a bottom edge of web member 149 define seating surfaces for horizontal rebar. The tapered openings between the triangular projections allow rebar of several different diameters including preferably at least up to #7 rebar to be positioned relative to bridging member 142. The inner edge 194' of outer triangular projections 194 can be substantially varied or parallel to the end plates such that any size horizontal rebar placed in the seating surfaces defined between triangular projections 194 and 192 will be positioned with a uniform distance between the outer edge of the rebar and the outer edge of concrete poured between the opposing panels.

Stacking pins 155 shown in FIGS. 2-6 and 255 shown in FIG. 7 can also provided to assist in positioning the bridging members relative to each other during shipping and storage. As seen in FIG. 7, an end plate 246 of one bridging member fits between the stacking pin 255 and end plate 246 of the bridging member on which it is stacked. The pins 155 may be integrally formed the bridging members.

Building components formed with the above-described bridging members may be molded into parallel foam panels and can be stacked up to form walls such as described in more detail in U.S. Pat. Nos. 5,809,727, 5,657,600 and 5,390,459, which are herein incorporated in their entirety by reference. The configurations of the bridging members described above were arrived at using finite element type structural analysis to produce a configuration that enabled the use of a minimal amount of material while still providing sufficient lateral strength in the bridging members to withstand forces exerted by concrete (or other building material) poured in between the foam panels and to provide a uniform load distribution. Another design parameter considered when conceptualizing the above-described "double-Y" configuration was a reduction in the vertical height between the top of the middle portion of the top web member and the bottom of the middle portion of the bottom web member. The double-Y configuration enables a greater number of completed building components formed from the bridging members and the foam panels to be stacked in the same height for shipping.

While the invention has been described in conjunction with specific embodiments thereof, it is evident that many alternatives, modifications and variations will be apparent to those skilled in the art in light of the foregoing description. For example, the web members disposed above and below the horizontal axis of the bridging member could be varied so that the bridging member is not entirely symmetrical. The web members could have a substantially X-shaped configuration or a substantially Y-shaped configuration between the opposing end plates or between the opposing strip members. Additionally, the V-shaped portions extending between the strip members and the end plates could include cross-bracing members for additional stability such that the number of openings through which the foam can pass molding of the building components is increased. Accordingly, the invention is intended to embrace all such alternatives, modifications, and variations as fall within the spirit and broad scope of the appended claims.

What is claimed is:

1. An apparatus for connecting opposing panels of an insulated concrete form, comprising:

a pair of end portions configured to connect opposing foam panels of the insulated concrete form, wherein said end portions comprise elongated end plates, each end plate having a length and a width, the length being at least twice the width;

at least two structural members joining said end portions, wherein each member includes receptacles for rebar disposed transversely to the length of the end plates; and at least one of the structural members including at least two projections defining a tapered open seating surface between the projections, said seating surface configured to at least partially surround and conform to rebar disposed substantially parallel to the length of the end plates;

wherein said apparatus is a single integrated unit molded of plastic, and wherein the seating surface is integrally molded onto a face of one of the two structural members, said projections projecting transversely to the length of the end plates.

2. The apparatus according to claim 1, wherein said seating surface comprises one of several seating surfaces disposed adjacent one another.

3. The apparatus according to claim 1, wherein said at least two structural members are substantially symmetrically disposed above and below a central horizontal axis of the connecting apparatus.

4. The apparatus of claim 1, further comprising at least one retaining member intersecting said at least one structural member to assist in positioning the connecting apparatus relative to the panels and resisting external loads applied to the end plates.

5. The apparatus according to claim 1 wherein said receptacles have a substantially V-shaped cross sectional shape.

6. The apparatus according to claim 1 wherein said receptacles space rebar disposed transversely to the length of the end plates at a constant distance from at least one of the end portions regardless of the size of the rebar.

7. The apparatus for connecting opposing panels of an insulated concrete form as recited in claim 1, in combination with rebar disposed in at least one of said receptacles, or rebar disposed against said seating surface, or a first rebar disposed in at least one of the receptacles and a second rebar disposed against said seating surface.

8. An apparatus for connecting opposing panels of an insulated concrete form, said apparatus comprising:

a pair of end portions configured to connect opposing foam panels of the insulated concrete form;

at least one structural member joining said end portions; and said at least one structural member including a projection defining a tapered open seating surface configured to contain rebar in substantially vertical disposition;

where said structural member further comprises a substantially V-shaped recess containing a substantially horizontally disposed rebar, said recess being substantially open and unobstructed and having a first edge that is substantially vertical and parallel to said end portions and a second edge inclined relative to the first edge to position the rebar against the first edge wherein the outer surface of rebar received within the recess is spaced a constant distance from at least one of the end portions regardless of the size of the rebar.

9. An insulated concrete form building component, comprising:

two insulating foam panels, each panel having inner and outer surfaces, said inner surfaces facing each other and spaced apart so that a cavity is formed between said foam panels, and each foam panel having a top and bottom, said top and bottom of each panel formed with features configured to connect the form building component with a like component to form a wall;

at least one molded plastic bridging member comprising two elongated end plates, each end plate having a width and a length at least twice the width, at least one of said two elongated end plates being molded into one of said two insulating foam panels such that the length of the at least one end late is oriented vertically between the top and bottom of the insulating foam panel into which the end plate is molded, said at least one molded plastic bridging member further comprising at least two structural members joining the two elongated end plates such that opposite end portions of said structural members are encased within said foam panels;

a seating surface integrally molded onto a vertical surface of each structural member, said seating surface configured to at least partially surround and conform to a vertical rebar rod disposed generally parallel to the length of the end plates, said seating surface residing between two protrusions molded into the face and protruding transversely to the length of the end plates.

10. The insulated concrete form building component of claim 9, wherein said elongated end plates are completely buried within said insulating foam panels.

11. The insulated concrete form building component of claim 9, wherein said elongated end plates comprise outer surfaces substantially flush with the outer surfaces of said insulating foam panels.

12. The insulated concrete form building component of claim 9, wherein said insulating foam panels are made of expanded polystyrene.

13. The insulated concrete form building component of claim 9, wherein said at least one molded plastic bridging member is molded of polypropylene, polyethylene, or polystyrene.

14. The insulated concrete form building component of claim 9, wherein said at least one molded plastic bridging member is molded of a flame-retardant polymer.

15. The insulated concrete form building component of claim 9, wherein said two structural members are generally symmetrically disposed above and below a central horizontal axis of the bridging member.

16. The insulated concrete form building component of claim 9, further comprising a pair of strip members oriented in a top-to-bottom direction of the panels and symmetrically disposed on opposite sides of a central vertical axis of the bridging member, said strip members lying in planes that are generally parallel to the inner surfaces of the panels and perpendicular to the plane of the structural members.

17. The insulated concrete form building component of claim 9, wherein said structural members further comprise a plurality of seats configured to position rebar disposed transversely to the length of the end plates.

18. The insulated concrete form building component of claim 17, wherein said seats are generally V-shaped, each having one substantially vertical edge such that each seat is configured to hold rebar a uniform distance from at least one of the elongated end plates regardless of the size of the rebar.

19. The insulated concrete form of claim 9, in combination with rebar disposed against said seating surface.

* * * * *

UNITED STATES PATENT AND TRADEMARK OFFICE

CERTIFICATE OF CORRECTION

PATENT NO. : 7,654,052 B2
APPLICATION NO. : 11/856593
DATED : February 2, 2010
INVENTOR(S) : Cooper et al.

It is certified that error appears in the above-identified patent and that said Letters Patent is hereby corrected as shown below:

At Col. 10, line 47, should read --at least one end plate is oriented...--

Signed and Sealed this

Sixth Day of April, 2010

David J. Kappos

David J. Kappos
*Director of the United States Patent and Trademark Office*